US012465828B2

(12) United States Patent
Goldberg

(10) Patent No.: US 12,465,828 B2
(45) Date of Patent: Nov. 11, 2025

(54) MULTI-GRIP MEDICINE BALL

(71) Applicant: Martin Goldberg, Mahopac, NY (US)

(72) Inventor: Martin Goldberg, Mahopac, NY (US)

( * ) Notice: Subject to any disclaimer, the term of this patent is extended or adjusted under 35 U.S.C. 154(b) by 77 days.

(21) Appl. No.: 18/667,460

(22) Filed: May 17, 2024

(65) Prior Publication Data

US 2024/0382815 A1 Nov. 21, 2024

Related U.S. Application Data

(60) Provisional application No. 63/502,960, filed on May 18, 2023.

(51) Int. Cl.
*A63B 65/06* (2006.01)
*A63B 21/00* (2006.01)
*A63B 21/072* (2006.01)

(52) U.S. Cl.
CPC ..... *A63B 65/06* (2013.01); *A63B 21/072* (2013.01); *A63B 21/4035* (2015.10)

(58) Field of Classification Search
CPC .... A63B 21/072; A63B 21/4035; A63B 65/06
See application file for complete search history.

(56) References Cited

U.S. PATENT DOCUMENTS 6,190,292 B1 * 2/2001 Panes ..... A63B 21/06 482/109
7,604,581 B1 * 10/2009 Williams ..... A63B 21/0004 482/140
8,568,280 B2 * 10/2013 Mendoza ..... A63B 21/0722 482/93
8,870,719 B2 * 10/2014 Johnson ..... A63B 21/072 482/44
8,882,642 B2 * 11/2014 Chavez ..... A63B 23/03575 482/121
8,944,971 B2 * 2/2015 Shorter ..... A63B 21/072 482/107
9,480,884 B2 * 11/2016 Tompkins ..... B32B 38/06
9,694,230 B2 * 7/2017 Cooper ..... A63B 21/072
9,694,236 B2 * 7/2017 Rost ..... A63B 22/16
9,770,619 B1 * 9/2017 Bullock ..... A63B 65/06
11,717,716 B2 * 8/2023 Koh ..... A63B 21/00076 482/110
11,931,619 B2 * 3/2024 Jackson ..... A63B 21/0726
12,357,871 B2 * 7/2025 Kordecki ..... A63B 23/0211
2001/0001094 A1 * 5/2001 Panes ..... A63B 65/06 482/109
2011/0111934 A1 * 5/2011 Taylor ..... A63B 41/125 482/139
2012/0157270 A1 * 6/2012 Johnson ..... A63B 21/072 482/93
2015/0190672 A1 * 7/2015 Rost ..... A63B 21/00065 482/141

* cited by examiner

*Primary Examiner* — Joshua Lee
(74) *Attorney, Agent, or Firm* — Mark H. Whittenberger; Holland & Knight LLP

(57) ABSTRACT

A multi-grip medicine ball may include a medicine ball having a body and an outer surface, and a plurality of paired grips may be disposed along the outer surface of the medicine ball. A rigid external framework may extend through the body of the medicine ball, such that a first portion of the rigid external framework may protrude from a first side of the body of the medicine ball and a second portion of the rigid external framework may protrude from a second side of the body of the medicine ball.

19 Claims, 8 Drawing Sheets

MULTI-GRIP MEDICINE BALL

CROSS-REFERENCE TO RELATED APPLICATIONS

This patent application claims the benefit of U.S. Provisional Application No. 63/502,960 filed May 18, 2023. This provisional application is incorporated by reference herein.

FIELD OF INVENTION

The present disclosure relates generally to fitness and exercise equipment. More particularly, the present disclosure relates to a weighted exercise ball having strategic handholds.

BACKGROUND

Conventional medicine balls are designed to emphasize balance, strength, and control by presenting a weighted sphere without dedicated handholds, which forces the user to adapt to non-standard handholds while engaging several smaller stabilizing muscles that are not commonly used in regular everyday activities. This "one size fits all" approach to utility forces the user to make whatever personal adjustments are necessary to lift, press, or otherwise utilize the medicine ball in a workout routine, regardless of the user's height, weight, wingspan, etc. The desirable effect of having to adapt and engage different groups of stabilizing muscles is somewhat offset by the lack of precision and consistency inherent to the experience. Additionally, forcing the user to adapt his/her grip whenever using conventional medicine balls increases the potential risk of injury from over-extending joints or unintentionally straining muscles. Further, conventional medicine balls are not designed to interact directly with other forms of exercise equipment.

Ultimately, having greater control over which muscle groups are engaged, when they are engaged, and how they are engaged provides a user with the opportunity to optimize their workout and to reduce the incidence of injury by more precisely targeting desired muscle groups. The present disclosure seeks to address these shortcomings of conventional medicine balls.

SUMMARY

As may be discussed in greater detail below, embodiments of the present disclosure of a multi-grip medicine ball are provided. The multi-grip medicine ball may include a medicine ball having a body and an outer surface, such that a plurality of paired grips may be disposed along the outer surface of the medicine ball. The multi-grip medicine ball may further include a rigid framework that extends internally through the body of the medicine ball, such that a first portion of the rigid external framework protrudes from a first side of the body of the medicine ball and a second portion of the rigid external framework protrudes from a second side of the body of the medicine ball.

One or more of the following features may be included. The multi-grip medicine ball may include a rigid internal framework disposed within the body of the medicine ball. The framework of the multi-grip medicine ball may manifest in a way wherein the rigid external framework and the rigid internal framework may intersect at multiple points where they may be adjoined to one another. The rigid internal framework may include a plurality of curved segments joined together at a top end and a bottom end to define a longitudinal portion of the internal framework. The rigid internal framework may further include a plurality of connector segments interposed between the plurality of curved segments to define a latitudinal portion of the internal framework. Both the first portion and second portion of the rigid external framework may include a connector loop disposed on the ends of each portion. The connector loops may be further configured to receive external attachments to the multi-grip medicine ball. Each paired grip in the plurality of paired grips may include a right indentation and a left indentation, such that the right indentation and the left indentation may be diametrically opposed to one another. The right indentation and the left indentation of each paired grip may be symmetrically positioned relative to a center line. The indentations of the graduated series of handholds may be disposed along a front end of the outer surface of the medicine ball. The indentations of the graduated series of handholds may be biased toward a bottom of the body of the medicine ball, such that each indentation cuts deeper into the bottom half of the body than they cut into a top half of the body. The rigid external framework may define a rectangular shape having a first handlebar disposed on the first portion and a second handlebar disposed on the second portion. The multi-grip medicine ball may further include a first gap defined between the rectangular shape of the rigid external framework and the first side of the body and a second gap defined between the rectangular shape of the rigid external framework and the second side of the body. The plurality of paired grips may define a graduated series of handholds on the surface of the multi-grip medicine ball. The body of the medicine ball may be made from a material having uniform mass and density. The outer surface of the medicine ball may be covered in small pebble-like protrusions.

Embodiments of the present disclosure of a personal fitness system for use in the home are provided. The personal fitness system may include a medicine ball having a body and an outer surface, such that a plurality of paired grips are disposed along the outer surface of the medicine ball. The multi-grip medicine ball may further include a rigid framework that extends internally through the body of the medicine ball, such that a first portion of the rigid external framework protrudes from a first side of the body of the medicine ball and a second portion of the rigid external framework protrudes from a second side of the body of the medicine ball.

One or more of the following features may be included. The personal fitness system may include a rigid internal framework disposed within the body of the medicine ball. The framework of the multi-grip medicine ball may manifest in a way wherein the rigid external framework and the rigid internal framework may intersect at multiple points where they may be adjoined to one another. The rigid internal framework may include a plurality of curved segments joined together at a top end and a bottom end to define a longitudinal portion of the internal framework.

The details of one or more example implementations are set forth in the accompanying drawings and the description below. Other possible example features and/or possible example advantages may become apparent from the description, the drawings, and the claims. Some implementations may not have those possible example features and/or possible example advantages, and such possible example features and/or possible example advantages may not necessarily be required of some implementations.

This summary is provided to introduce a selection of concepts that are further described below in the detailed description. This summary is not intended to identify essential features of the claimed subject matter, nor is it intended to be used as an aid in limiting the scope of the claimed subject matter.

BRIEF DESCRIPTION OF THE DRAWINGS

Embodiments of the present disclosure are described with reference to the following figures.

Like reference symbols in the various drawings may indicate like elements.

DETAILED DESCRIPTION

Figure 1:
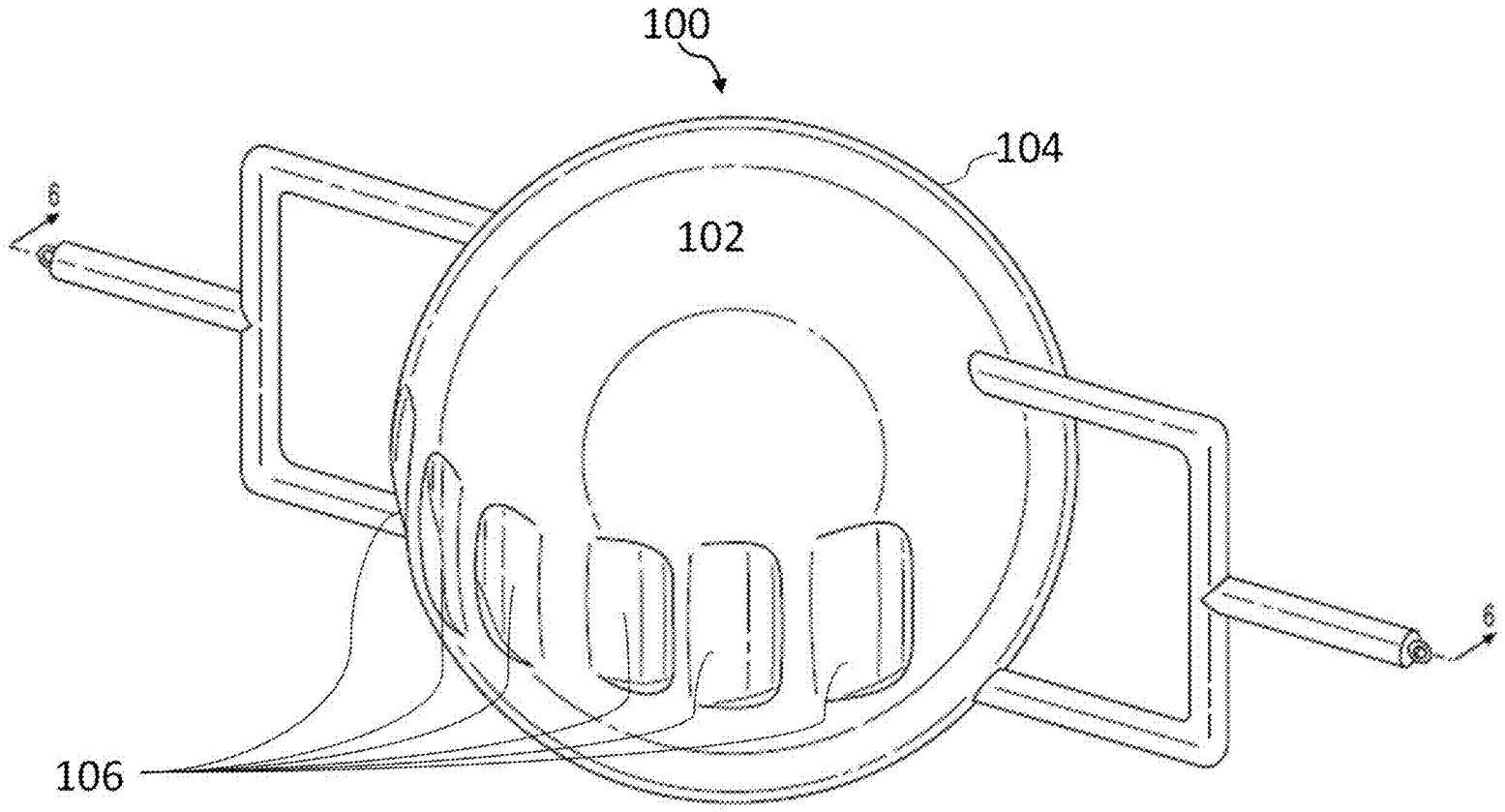
FIG. 1 shows a perspective view of a multi-grip medicine ball in accordance with the present disclosure.

The discussion below is directed to certain implementations. It is to be understood that the discussion below is only for the purpose of enabling a person with ordinary skill in the art to make and use any subject matter defined now or later by the patent "claims" found in any issued patent herein.

It is specifically intended that the claimed combinations of features not be limited to the embodiments and/or implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

It may also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The device disclosed herein has a broad variety of applications, all relating to physical fitness. Specifically, a medicine ball may be designed to fully engage all the muscles of the upper body that may be used in pushing. In addition to greater muscular activation the shape and adaptability of the ball to users of different heights may allow the enhanced muscular demand to take place at a reduced level of the types of joint injury associated with pressing exercises performed with excessive range of motion using a straight bar.

The present disclosure seeks to address the shortcomings of conventional medicine balls by introducing a series of graduated handholds to the medicine ball and also seeks to provide expanded functionality by facilitating joint use of the medicine ball alongside other forms of exercise equipment.

By using a graduated series of handholds users of a large range of heights may be able to have an experience that strongly approximates working with a ball fitted to their specific size. The spherical shape forces the user to not only push outward but squeeze their hands towards each other as they push. That combination of actions may fully engage the pectoral muscles as well as the anterior and medial deltoids and the triceps.

Due to the shape of the device, the user may be prevented from over-stretching the shoulder capsule and the elevated risk of shoulder joint injury that accompanies allowing the extended range of motion during a push-up type of exercise. The leading curve of the ball creates an intrinsic block, preventing the user from overextending the joint.

By placing the points of attachment away from the ball itself the user may experience increased benefits in safety, comfort, and fitness. By having the ball attached to some means of resistance (straps, chains) the user may no longer be subject to abrasions and/or bruising on the outside of their arms and shoulders, as they may be when they use standard handle and strap apparatus currently. In addition to the direct results of unwanted friction, there may be a secondary area of potential injury that having wider attachments may help avoid. The above-mentioned unwanted impact of unavoidable contact creates a tendency in those exercising to allow their hands to drift upward towards their shoulders as each repetition increases the likelihood of skin irritation. This unconscious change in hand placement compresses the shoulder joint increasing the possibility of soft tissue injury. By eliminating that possibility, the device may allow users to keep their hands in a more joint-neutral place, encouraging greater pectoral development and minimizing injury risk.

Figure 2:
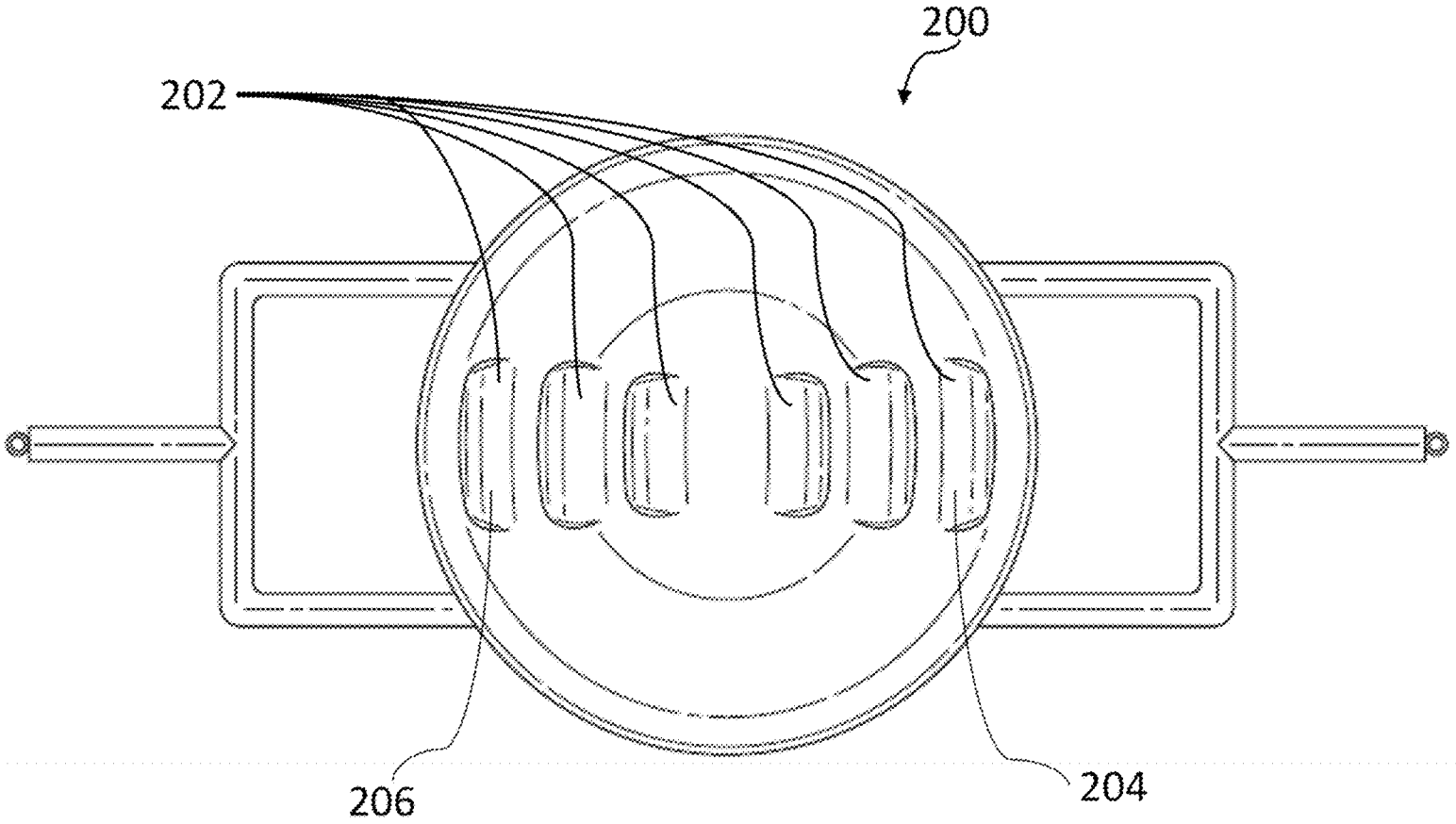
FIG. 2 shows a frontal view of a multi-grip medicine ball in accordance with the present disclosure.
Figure 3:
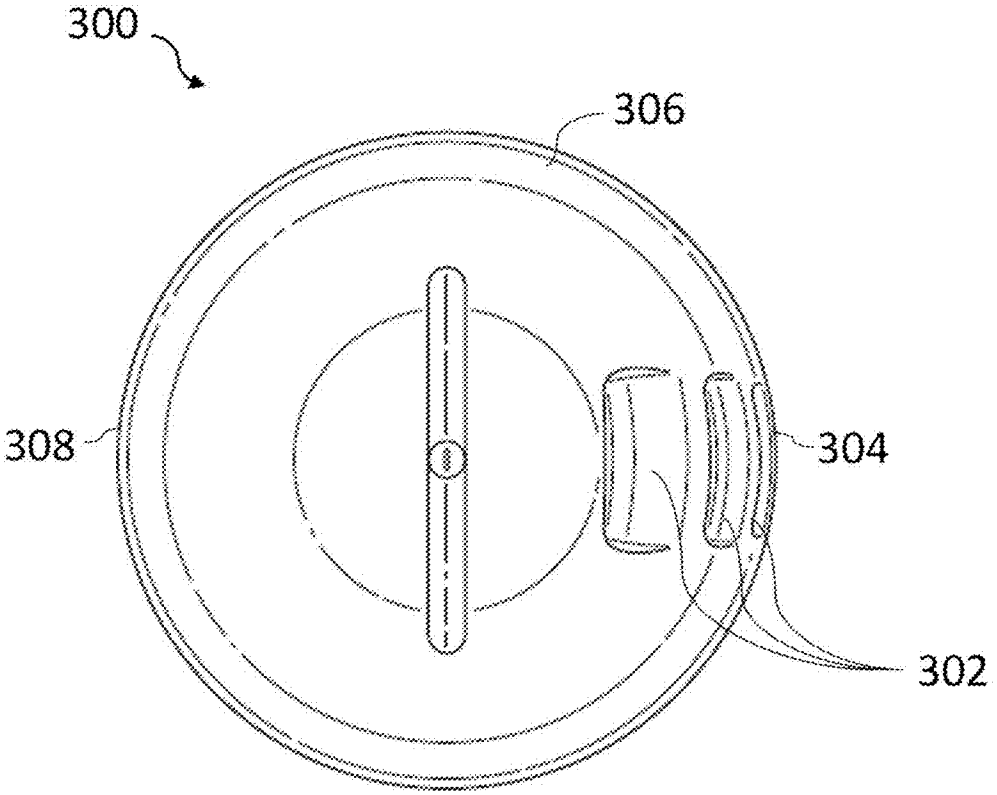
FIG. 3 shows a side view of a multi-grip medicine ball in accordance with the present disclosure.

Referring now to FIGS. 1, 2, & 3, a multi-grip medicine ball 100 having a body 102 and an outer surface 104 is shown. A plurality of paired grips 106 may be evenly distributed along the front side of the outer surface 104 of the medicine ball 100. Each pair of grips from the plurality of paired grips 202 includes a righthand grip 204 and a lefthand grip 206, such that righthand grip 204 and lefthand grip 206 may be symmetrically positioned about a center line as shown in FIG. 2. Additionally, in each pair the righthand grip 204 may be oriented in the opposite direction of the lefthand grip 206, such that when considered together they present a mirrored symmetry with respect to one another as shown in FIG. 2. Further, the plurality of paired grips 302 define a graduated series of handholds disposed along a front end 304 of the outer surface 306 of the medicine ball 300, such that no handholds may be included along the rear end 308 thereby allowing rear end 308 to retain the rounded shape of a normal ball as shown in FIG. 3.

In some embodiments, the body 102 of the ball 100 may be composed of a material having uniform mass and density, such as a hard rubbery material allowing for the outer surface 104 to be covered in small pebble-like protrusions to make the outer surface 104 easier to hold onto. In other embodiments, the circumference of medicine ball 200 may be sized and proportioned to ensure that the outermost grips 204, 206 sit in parallel to each other thereby allowing a user measuring 74-78 inches in height to be able to push themselves away from the ball 100 while maintaining a perfectly neutral position, with respect to the standard shoulder width of someone within the above-mentioned height range as shown in FIG. 2. Further, each subsequent pair of grips from the plurality of paired grips may be positioned at uniform intervals, moving inwards toward the center line, such that the innermost pair of grips of the plurality of paired grips 202 may be comfortable for use by a person measuring 59-63 inches in height. Moreover, with each subsequent pair of grips, the plurality of paired grips may be incrementally smaller, moving inward toward the center line, in anticipation of the relatively smaller hand sizes of users who may be more likely to use the inner grips.

Figure 4:
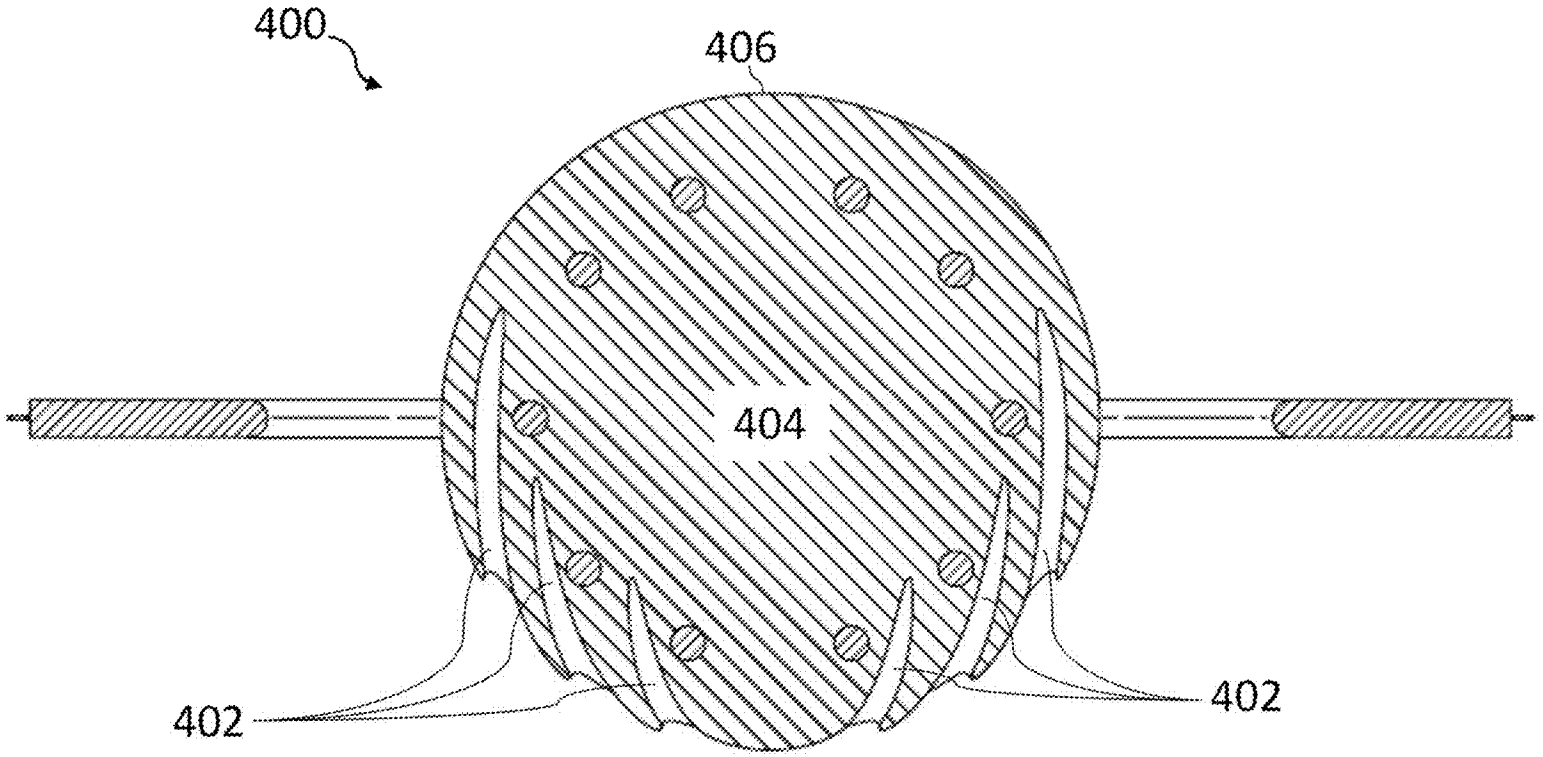
FIG. 4 shows a downward cross-sectional view of a multi-grip medicine ball in accordance with the present disclosure along cutting plane 6.
Figure 5:
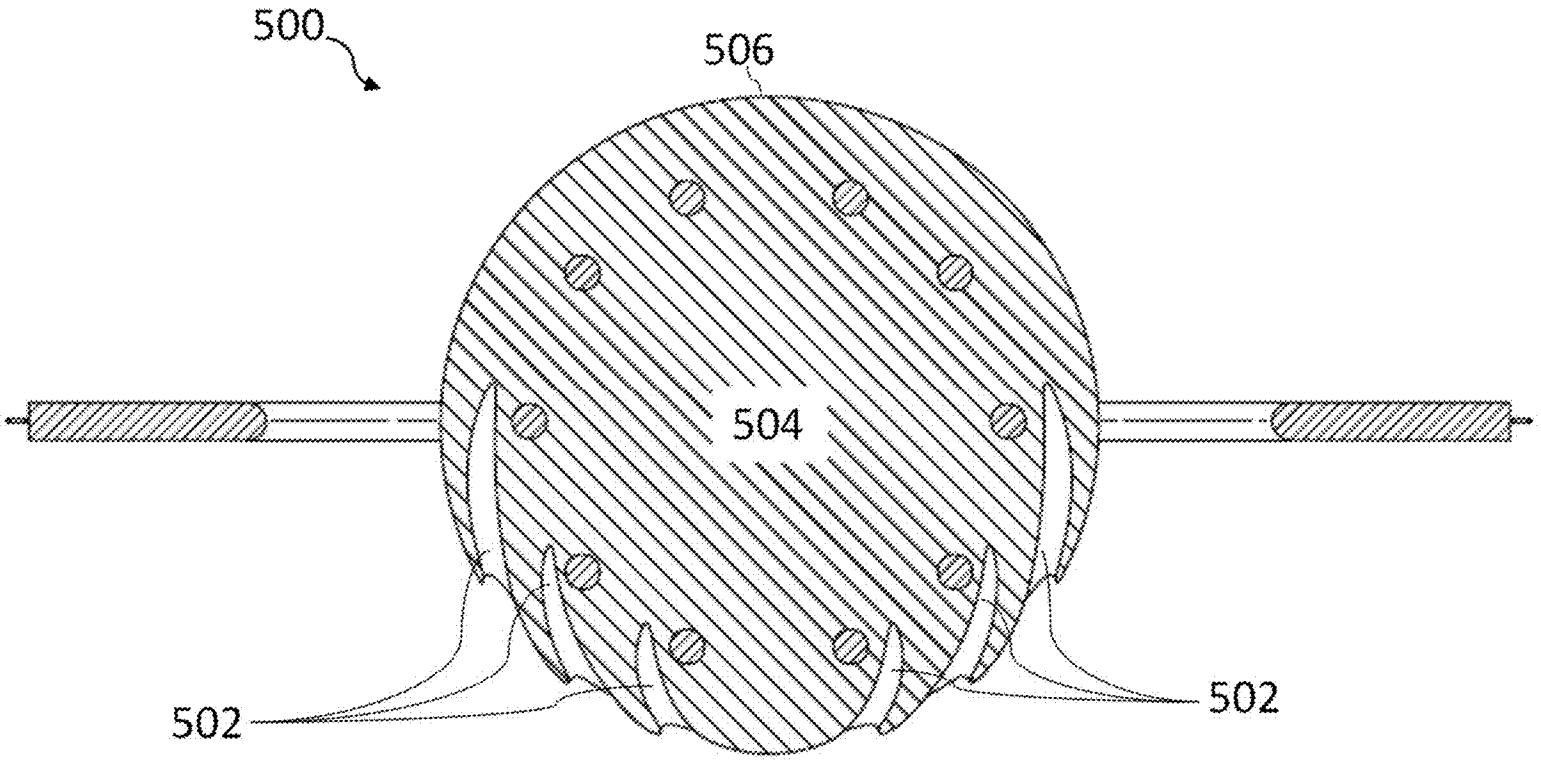
FIG. 5 shows an upward cross-sectional view of a multi-grip medicine ball in accordance with the present disclosure along cutting plane 6.

Referring now to FIGS. 4 and 5, the plurality of paired grips 402,502 may be shaped into body 404, 504 by means of invagination along the surface 406, 506 of medicine ball 400, 500. Each grip of the plurality of paired grips 402, 502 may be shaped to simulate the outer edge of medicine ball 400, 500, such that the internal surface of the grip may mimic the curvature and texture of the circumferential edge of medicine ball 400, 500. Accordingly, each grip of the plurality of grips 402/502 may be defined by a curved indentation that may be cut out from the body 404/504. In use, the user's thumb may lay over the outer surface 406, 506 of the ball, and the four other fingers may be inserted into any one of the curved indentations of the plurality of grips 402, 502 and press in as if they were on the outer edge of medicine ball 400, 500. Further, the plurality of paired grips 402, 502 may be biased toward the lowest point of body 404, 504 of medicine ball 400, 500, such that each indentation cuts deeper into the bottom half of the body 404 as shown in FIG. 4 when compared to the indentation cut into the top half of the body 504, as shown in FIG. 5.

Figure 6:
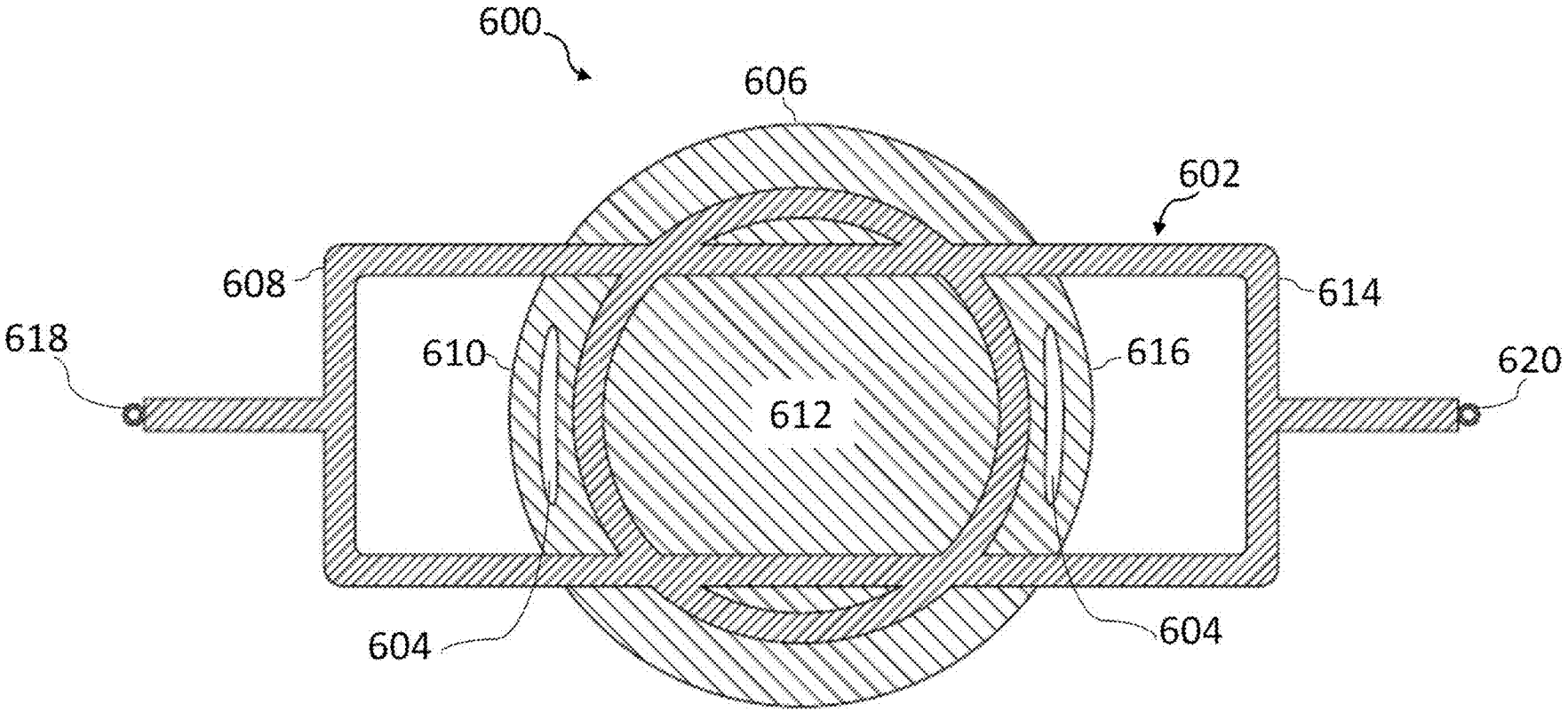
FIG. 6 shows a lengthwise cross-sectional view of a multi-grip medicine ball in accordance with the present disclosure along cutting plane 4.

Referring now to FIGS. 6, an elongated bar 602 is shown passing through the center of medicine ball 600. Elongated bar 602 may be perpendicularly oriented with respect to the plurality of paired grips 604, and protrudes approximately one and one-half feet from each side of the outer surface 606 of medicine ball 600. A first portion 608 of elongated bar 602 may protrude from a first side 610 of the body 612 of the medicine ball 600 and a second portion 614 of elongated bar 602 may protrude from a second side 616 of the body 612 of the medicine ball 600. Further, elongated bar 602 may be considered a rigid external framework of medicine ball 600, because first portion 608 and second portion 614 may provide external structures for users to see and interact with. This external framework may be in contrast to an internal framework that may not be seen or manipulated by users. Each side of the elongated bar 602 may terminate in a connector loop made from the same material that comprises elongated bar 602, such that first portion 608 of elongated bar 602 may terminate in a first connector loop 618 and second portion 614 of elongated bar 602 may terminate in a second connector loop 620. Connector loops 618, 620 may be configured to facilitate attachment of medicine ball 600 to a broad variety of straps, which may be suspended or otherwise anchored.

In some embodiments, elongated bar 602 may be of sufficient weight-bearing capacity to be used in standard (bench press) form. Connector loops 618, 620 may be used to attach the elongated bar 602 to a receiving bar (not shown) of the same length, which in turn may be attached to a variety of forms of resistance so that the device may be used in a standing posture. The types of resistance include but may not be limited to: (i) resistance bands or tubing, (ii) freewheel ergometer, (iii) redistributable weight stack, via cable pulley system, (iv) hydraulic resistance, (v) pneumatic resistance, and (vi) plate loading cable pulley system. Further, connector loops 618, 620 may also be used to frame medicine ball 600 onto a Smith machine (not shown) thereby allowing the user to gain the advantages associated with the enhanced grip that medicine ball 600 affords while enjoying the safety that Smith machines generally provide. Similarly, medicine ball 600 may be affixed to a weight-bearing receptacle, such as a sled, or a cart. Alternatively, medicine ball 600 may be attached to an aquatic frame, such as paddle projections, for use in the water. Additionally, the wide spacing of connector loops 618, 620 may prevent any contact between the user and whatever might connect the device with the source of resistance. As constructed the space needed to use this medicine ball may be small enough to allow for home gym usage.

Figure 7:
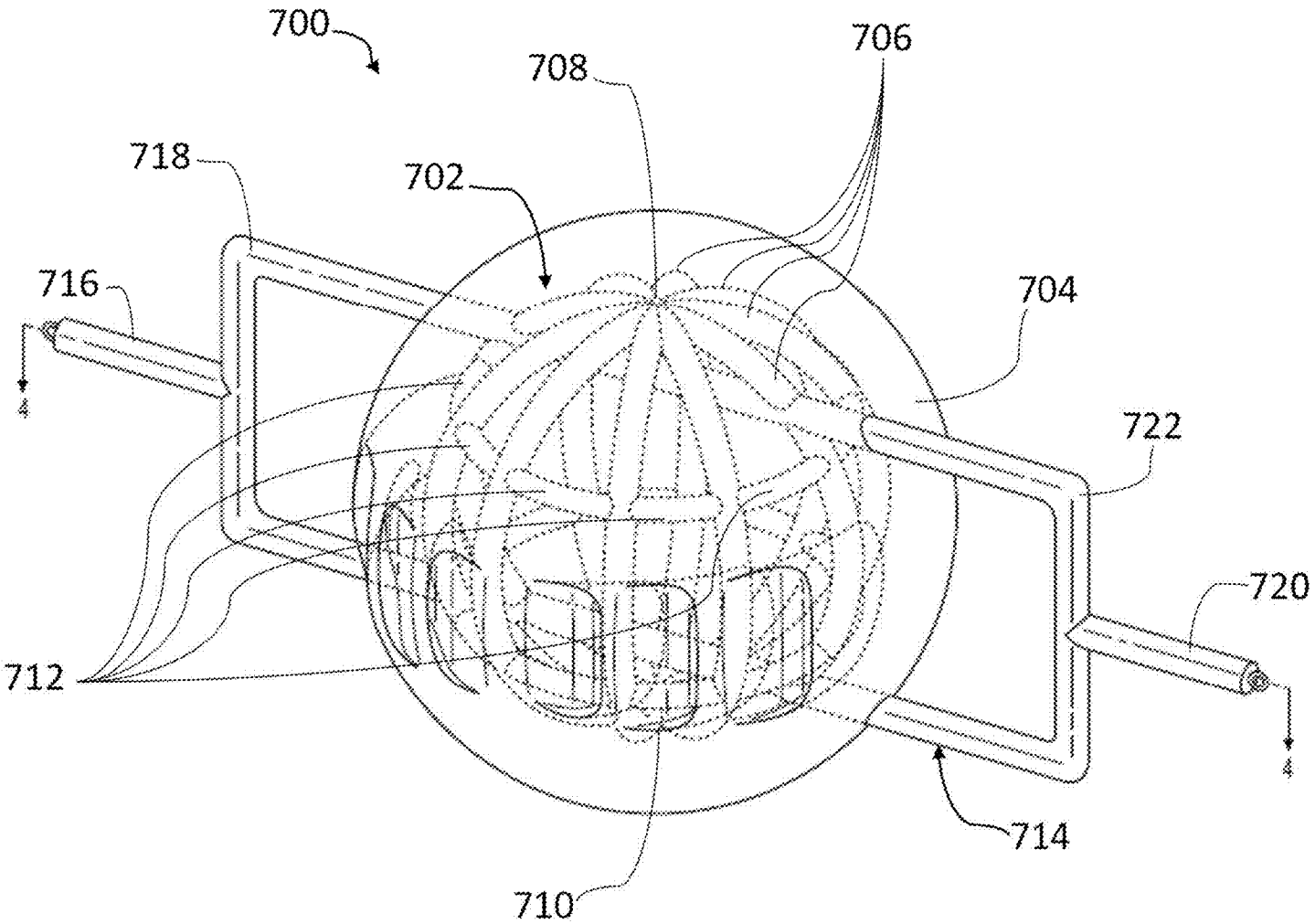
FIG. 7 shows a schematic view of the internal structure of a multi-grip medicine ball in accordance with the present disclosure.

Referring now to FIG. 7 an internal framework 702 is shown to be encased within the body 704 of medicine ball 700. Internal framework 702 may include a plurality of curved segments 706 joined together at a top end 708 and a bottom end 710 to define a longitudinal portion of the internal framework 702. A plurality of connector segments 712 may be interposed between the plurality of curved segments 706 to define a latitudinal portion of internal framework 702. Within the body 704 of medicine ball 700 elongated bar 714 intersects with internal framework 702 at multiple points where they may be adjoined to one another. In this embodiment, elongated bar 714 may be rectangular in shape and may include a first handlebar 716 disposed on the first portion 718 and a second handlebar 720 disposed on the second portion 722. In some embodiments, a first gap may be defined between the elongated bar 714 and the first side of body 704, and a second gap may be defined between the elongated bar 714 and the second side of body 704.

In other embodiments, the medicine ball may be fabricated so that instead of an elongated bar 714 running through the center in a direction perpendicular to the plurality of paired grips, a short bar (not shown) running parallel to the plurality of paired grips may be placed so that it protrudes from medicine ball 700 on only one side. The short bar may then be affixed to an overhead rocker arm with varying levels of attachment to allow for differences in user height. In such a configuration the user may work against resistance to mimic the act of throwing a medicine ball. The types of resistance may be identical to those discussed above.

Figure 8:
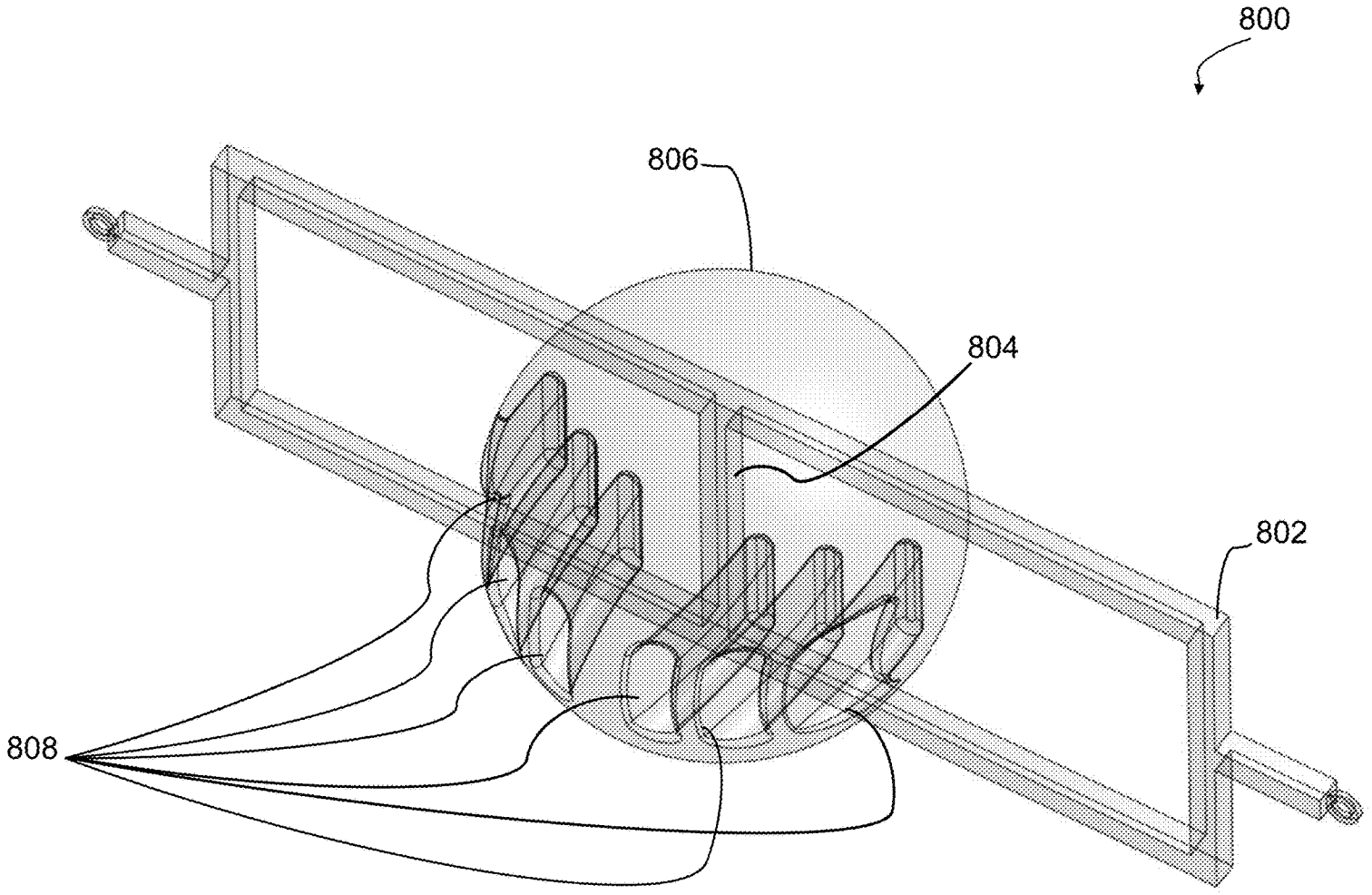
FIG. 8 shows a perspective view of a multi-grip medicine ball in accordance with the present disclosure.

Referring now to FIG. 8, an elongated bar 802 is shown passing through the center of medicine ball 800. In some embodiments, medicine ball 800 may eschew the use of the previously mentioned internal framework 702. Instead of a skeletal structure having gaps and empty spaces, medicine ball 800 may use a solid block of material, and elongated bar 802 may include central bar 804 disposed at the midway point of elongated bar 802. Central bar 804 may be embedded within the solid block of material comprising body 806 of medicine ball 800 for added stability, and to ensure that the portions of elongated bar 802 that protrude on either side of body 806 remain securely locked in place. Elongated bar 802 may be fabricated from a lightweight material that may still be able to support a user of average size and weight. Additionally, the plurality of paired grips 808 may extend inward into body 806 such that central bar 804 may be positioned in between the rightward half of paired grips 808 and the leftward half of paired grips 808.

The terminology used herein is for the purpose of describing particular embodiments and is not intended to be limiting of the disclosure. As used herein, the singular forms "a", "an" and "the" are intended to include the plural forms as well, unless the context clearly indicates otherwise. It may be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations may be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

Although a few example embodiments have been described in detail above, those skilled in the art may readily appreciate that many modifications are possible in the example embodiments without materially departing from the scope of the present disclosure, described herein. Accordingly, such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail, and a screw may be equivalent structures. It is the express intention of the applicant not to invoke 35 U.S.C. § 112, paragraph (f) for any limitations of any of the claims herein, except for those in which the claim expressly uses the words 'means for' or 'step for' together with an associated function.

Having thus described the disclosure of the present application in detail and by reference to embodiments thereof, it may be apparent that modifications and variations are possible without departing from the scope of the disclosure defined in the appended claims.

What is claimed is:

1. A multi-grip medicine ball comprising:

a medicine ball having a body and an outer surface;

a plurality of paired grips disposed along the outer surface of the medicine ball;

a rigid external framework extending through the body of the medicine ball;

a first portion of the rigid external framework protrudes from a first side of the body of the medicine ball; and a second portion of the rigid external framework protrudes from a second side of the body of the medicine ball, wherein each paired grip in the plurality of paired grips includes a right indentation and a left indentation, such that the right indentation and the left indentation are diametrically opposed to one another.

2. The multi-grip medicine ball of claim 1, wherein a rigid internal framework is disposed within the body of the medicine ball.

3. The multi-grip medicine ball of claim 2, wherein the external framework and the internal framework intersect at multiple points where they are adjoined to one another.

4. The multi-grip medicine ball of claim 3, wherein the rigid internal framework includes a plurality of curved segments joined together at a top end and a bottom end to define a longitudinal portion of the internal framework.

5. The multi-grip medicine ball of claim 4, wherein the rigid internal framework includes a plurality of connector segments interposed between the plurality of curved segments to define a latitudinal portion of the internal framework.

6. The multi-grip medicine ball of claim 1, wherein both the first portion and second portion of the rigid external framework each includes a connector loop disposed on an end of each portion.

7. The multi-grip medicine ball of claim 6, wherein the connector loops are configured to receive external attachments to the multi-grip medicine ball.

8. The multi-grip medicine ball of claim 1, wherein the right indentation and the left indentation of each paired grip are symmetrically positioned relative to a center line.

9. The multi-grip medicine ball of claim 1, wherein indentations of a graduated series of handholds are disposed along a front end of the outer surface of the medicine ball.

10. The multi-grip medicine ball of claim 1, wherein the indentations of the graduated series of handholds are biased toward a bottom of the body of the medicine ball, such that each indentation cuts deeper into a bottom half of the body than they cut into a top half of the body.

11. The multi-grip medicine ball of claim 1, wherein the rigid external framework defines a rectangular shape having a first handlebar disposed on the first portion and a second handlebar disposed on the second portion.

12. The multi-grip medicine ball of claim 11, wherein a first gap is defined between the rectangular shape of the rigid external framework and the first side of the body, and a second gap is defined between the rectangular shape of the rigid external framework and the second side of the body.

13. The multi-grip medicine ball of claim 1, wherein the plurality of paired grips define a graduated series of handholds.

14. The multi-grip medicine ball of claim 1, wherein the body of the medicine ball is made from a material having uniform mass and density.

15. The multi-grip medicine ball of claim 1, wherein the outer surface of the medicine ball is covered in small pebble-like protrusions.

16. A personal fitness system for use in the home, the personal fitness system comprising:

a multi-grip medicine ball including:

a medicine ball having a body and an outer surface;

a plurality of paired grips disposed along the outer surface of the medicine ball;

a rigid external framework extending through the body of the medicine ball;

a first portion of the rigid external framework protrudes from a first side of the body of the medicine ball; and a second portion of the rigid external framework protrudes from a second side of the body of the medicine ball, wherein each paired grip in the plurality of paired grips includes a right indentation and a left indentation, such that the right indentation and the left indentation are diametrically opposed to one another.

17. The personal fitness system of claim 16, wherein a rigid internal framework is disposed within the body of the medicine ball.

18. The personal fitness system of claim 17, wherein the external framework and the internal framework intersect at multiple points where they are adjoined to one another.

19. The personal fitness system claim 18, wherein the rigid internal framework includes a plurality of curved segments joined together at a top end and a bottom end to define a longitudinal portion of the internal framework.

* * * * *